US009707663B2

(12) United States Patent
Shiro et al.

(10) Patent No.: US 9,707,663 B2
(45) Date of Patent: Jul. 18, 2017

(54) POLISHING PAD

(75) Inventors: Kuniyasu Shiro, Kyoto (JP); Masaharu Wada, Kyoto (JP); Hiroyasu Kato, Kyoto (JP); Hajime Nishimura, Otsu (JP); Satoshi Yanagisawa, Anpachi-gun (JP); Yukihiro Matsuzaki, Anpachi-gun (JP)

(73) Assignees: Toray Industries, Inc., Tokyo (JP); Toray Coatex Co., Ltd., Kyoto (JP)

( * ) Notice: Subject to any disclaimer, the term of this patent is extended or adjusted under 35 U.S.C. 154(b) by 608 days.

(21) Appl. No.: 14/001,791

(22) PCT Filed: Jan. 30, 2012

(86) PCT No.: PCT/JP2012/051947

§ 371 (c)(1),
(2), (4) Date: Aug. 27, 2013

(87) PCT Pub. No.: WO2012/117789

PCT Pub. Date: Sep. 7, 2012

(65) Prior Publication Data

US 2013/0331014 A1 Dec. 12, 2013

(30) Foreign Application Priority Data

Feb. 28, 2011 (JP) ..... 2011-041948

(51) Int. Cl.

| | |
|---|---|
| ***D06N 3/00*** | (2006.01) |
| ***D06N 3/14*** | (2006.01) |
| ***B24B 37/24*** | (2012.01) |

(52) U.S. Cl.

CPC ..... *B24B 37/24* (2013.01); *D06N 3/0004* (2013.01); *D06N 3/14* (2013.01); *D06N 2205/24* (2013.01)

(58) Field of Classification Search

CPC ..... B24B 37/24; B24B 37/22; B24D 11/00; B24D 3/28; B24D 3/002

(Continued)

(56) References Cited

U.S. PATENT DOCUMENTS 6,800,019 B2 * 10/2004 Tanaka ..... B24B 37/042 428/903
2003/0013382 A1 * 1/2003 Tanaka et al. ..... 451/36

(Continued)

FOREIGN PATENT DOCUMENTS

JP 44-18369 Y1 8/1969
JP 11-335979 A 12/1999

(Continued)

OTHER PUBLICATIONS

International Search Report dated Mar. 19, 2012, from PCT International Application No. PCT/JP2012/051947.

*Primary Examiner* — Larry E Waggle, Jr.
*Assistant Examiner* — Lauren Beronja
(74) *Attorney, Agent, or Firm* — RatnerPrestia

(57) ABSTRACT

A polishing pad is provided with a compression elastic modulus of 0.17 MPa or more and 0.32 MPa or less produced by preparing a nonwoven fabric formed of bundles of ultrafine fibers with an average monofilament diameter of 3.0 μm or more and 8.0 μm or less, preparing a polishing pad base by impregnating the nonwoven fabric with a polyurethane based elastomer in an amount of 20 mass % or more and 50 mass % or less relative to the mass of the polishing pad base, and laminating the polishing pad base with a porous polyurethane layer containing wet-solidified polyurethane as primary component which has openings with an average opening diameter of 10 μm or more and 90 μm or less in its surface to serve as polishing surface layer.

5 Claims, 1 Drawing Sheet

(58) Field of Classification Search
USPC ..... 451/534, 533, 526, 532, 536; 51/297, 51/298, 293
See application file for complete search history.

(56) References Cited

U.S. PATENT DOCUMENTS

| | | | | |
|---|---|---|---|---|
| 2007/0010175 | A1 | 1/2007 | Feng et al. | |
| 2008/0268227 | A1 | 10/2008 | Feng et al. | |
| 2010/0087128 | A1* | 4/2010 | Nakayama | B24B 37/24 451/548 |
| 2011/0003536 | A1* | 1/2011 | Feng et al. | 451/41 |

FOREIGN PATENT DOCUMENTS

| | | | | |
|---|---|---|---|---|
| JP | 2001-223189 | A | | 8/2001 |
| JP | 2004-299041 | A | | 10/2004 |
| JP | 2007069304 | A | * | 3/2007 |
| JP | 2007-196336 | A | | 8/2007 |
| JP | 2008-277518 | A | | 11/2008 |
| JP | 2009-228179 | A | | 10/2009 |
| KR | 2009038048 | A | * | 4/2009 |
| KR | 2009038048 | A | * | 4/2009 |

* cited by examiner

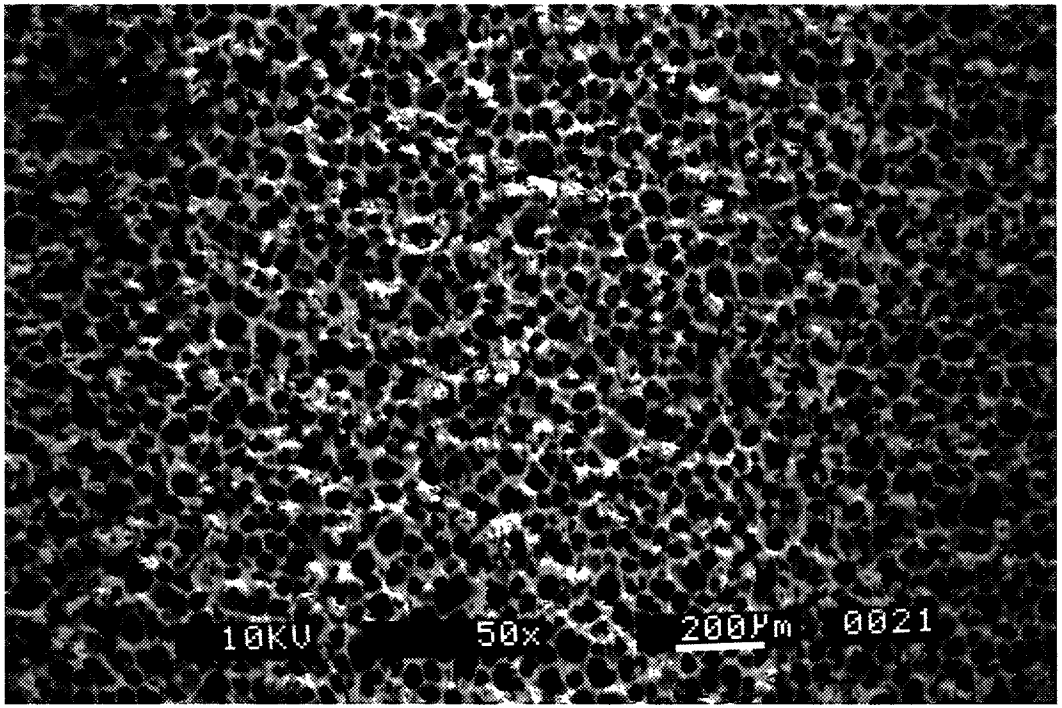
10KV
50x
200μm
0021

POLISHING PAD

CROSS-REFERENCE TO RELATED APPLICATIONS

This application is the U.S. National Phase application of PCT International Application No. PCT/JP2012/051947, filed Jan. 30, 2012, and claims priority to Japanese Patent Application No. 2011-041948, filed Feb. 28, 2011, the disclosures of both of which are incorporated herein by reference in their entireties for all purposes.

FIELD OF THE INVENTION

The present invention relates to a polishing pad suitable for finishing silicon bare wafers, glass, compound semiconductor substrates, hard disk substrates, and the like to produce good mirror finished surfaces.

BACKGROUND OF THE INVENTION

Conventionally, a polishing pad is produced by using, as base material, a nonwoven fabric or textile fabric formed of synthetic fibers with synthetic rubber or the like, coating its surface with a polyurethane based solution, solidifying the polyurethane based solution by a wet solidification technique to form a porous surface layer having continuous air holes, followed by grinding or removing the top surface of the surface layer as required (see patent document 1). In this polishing pad, the ground surface of the polishing pad is formed only of a porous polyurethane layer with none of the fibers constituting the base material exposed from the surface.

This type of polishing pads have already been in wide use as polishing pads for precision polishing of surfaces of electronic components including liquid crystal glass, glass disk, photomask, silicon wafers, and CCD cover glass. A polishing pad used for precision polished is required to have high accuracy in terms of aperture diameter variation and flatness (surface irregularities) in porous portions in the surface. In recent years, however, as sophisticated measuring instruments for fine-polished surfaces are developed and at the same time increased quality is demanded by users, that are increased needs for polishing pads that can meet demands for higher-precision polishing.

Conventional polishing pads as described above include polishing pads that are produced by impregnating with a polyurethane elastomer solution a needle punched nonwoven fabric formed of polyester short fibers with an average fiber diameter of 14 μm, wet-solidifying it in water, rinsing it, drying it, and buffing it to prepare a base material, followed by coating with a polyurethane solution and wet solidification (see patent document 1). However, it has been difficult for this technique to produce polishing pads that serve for polishing without causing defects such as scratches and particles on the mirror finished surfaces and serve for mirror-finishing an increased number of surfaces.

Aside from this, there is a proposal of a full grain leather-like sheet material formed of a grain layer of polyurethane combined with a base of a nonwoven fabric of polyurethane-containing ultrafine fibers with an average monofilament fineness of 0.001 dtex or more and 0.5 dtex or less (see patent document 2). The above proposal suggests that the material can serve as industrial tools such as polishing pads as one of its applications. However, the proposed full grain leather-like sheet material does not have an open polishing surface layer and does not have a uniform thickness, and it is difficult for such polishing pads to serve for polishing without causing defects such as scratches and particles on the mirror finished surfaces or serve for mirror-finishing an increased number of surfaces.

PATENT DOCUMENTS

Patent document 1: Japanese Unexamined Patent Publication (Kokai) No. HEI 11-335979

Patent document 2: Japanese Unexamined Patent Publication (Kokai) No. 2009-228179

SUMMARY OF THE INVENTION

Thus, in view of the aforementioned conventional technique as background, the present invention aims to provide a polishing pad that is useful to produce good mirror finished surfaces in products such as silicon bare wafer, glass, compound semiconductor substrate, and hard disk substrate and that serves for polishing without causing defects such as scratches and particles on the mirror finished surfaces and serve for mirror-finishing an increased number of surfaces.

The present invention is intended to solve the above problem, and the polishing pad according to an embodiment of the present invention is produced by preparing a nonwoven fabric formed of bundles of ultrafine fibers with an average monofilament diameter of 3.0 μm or more and 8.0 μm or less, preparing a polishing pad base by impregnating the nonwoven fabric with a polyurethane based elastomer in an amount of 20 mass % or more and 50 mass % or less relative to the mass of the polishing pad base, and laminating the polishing pad base with a porous polyurethane layer containing wet-solidified polyurethane as primary component, characterized in that the porous polyurethane layer has openings with an average opening diameter of 10 μm or more and 90 μm or less in its surface and that the compression elastic modulus is 0.17 MPa or more and 0.32 MPa or less.

In a preferred embodiment of the polishing pad of this invention, the aforementioned ultrafine fibers have an average monofilament diameter of 3.5 μm or more and 6.0 μm or less.

In a preferred embodiment of the polishing pad of this invention, the content of the polyurethane based elastomer in the polishing pad base is 20 mass % or more and 30 mass % or less.

In a preferred embodiment of the polishing pad of this invention, the nonwoven fabric contains a nitrile butadiene based elastomer.

In a preferred mode of the polishing cloth of this invention, the ultrafine fibers constituting the nonwoven fabric have an average monofilament diameter CV value of 10% or less.

The present invention serves to provide a polishing pad that is useful for finishing to produce good mirror finished surfaces in products such as silicon bare wafer, glass, compound semiconductor substrate, and hard disk substrate and also serve to perform polishing without causing defects such as scratches and particles on the mirror finished surfaces and mirror-finish an increased number of surfaces.

BRIEF DESCRIPTION OF THE DRAWINGS

FIG. 1 is a photograph that substitutes for a drawing to show openings in the surface of a porous polyurethane layer of a polishing pad according to an embodiment of the present invention.

DESCRIPTION OF EMBODIMENTS OF THE INVENTION

The polishing pad according to an embodiment of the present invention is produced by preparing a nonwoven fabric formed of bundles of ultrafine fibers with an average monofilament diameter of 3.0 μm or more and 8.0 μm or less, preparing a polishing pad base by impregnating the nonwoven fabric with a polyurethane based elastomer in an amount of 20 mass % or more and 50 mass % or less relative to the mass of the polishing pad base, and laminating the polishing pad base with a porous polyurethane layer containing wet-solidified polyurethane as primary component, characterized in that the porous polyurethane layer has openings with an average opening diameter of 10 μm or more and 90 μm or less in its surface.

Examples of the polymer to form ultrafine fibers (fiber bundles) to be used for this invention include, for instance, polyesters, polyamides, polyolefins, and polyphenylene sulfide (PPS). Many of polycondensation polymers typified by polyesters and polyamides are high in melting point and excellent in heat resistance, and consequently they have been used favorably. Examples of such polyesters include polyethylene terephthalate (PET), polybutylene terephthalate, and polytrimethylene terephthalate. Further, examples of such polyamides include nylon 6, nylon 66, and nylon 12.

Further, the polymer constituting the ultrafine fibers (fiber bundles) may be copolymerized with other components, and may contain additives such as particles, flame retarder, and antistatic agent.

It is important for the ultrafine fibers constituting the ultrafine fiber bundles to have an average monofilament diameter of 3.0 μm or more 8.0 μm or less. If the average monofilament diameter is 8.0 μm or less, the resulting mirror finished surface will suffer from less defects such as scratches and particles. This is considered to be because the polishing pad according to the present invention preferably has a porous polyurethane layer on the surface that comes in contact with an object to be polished, so that fibers do not come in direct contact with the object to be polished. Accordingly, the use of fibers with an average monofilament diameter of 8.0 μm or less to form the polishing pad base may serve to allow a uniform stress to be applied to the surface to be polished, when a polishing pad formed thereof is used. An average monofilament diameter of 3.0 μm or more, on the other hand, will serve to increase the number of surfaces that can be polished for mirror finishing. It is more preferable for the ultrafine fibers to have an average monofilament diameter of 3.5 μm or more and 6.0 μm or less.

Furthermore, ultrafine fibers (fiber bundles) used for the present invention preferably have an average monofilament diameter CV value in the range of 0.1 to 10%. Fibers with a smaller CV value have more uniform monofilament diameters.

For exemplary embodiments of the present invention, an average monofilament diameter CV value of 10% or less ensures that the ultrafine fibers have uniform monofilament diameters to produce a uniformly gigged surface. The CV value in average monofilament diameter is preferably as small as possible, but substantially it is 0.1 or more.

Methods for achieving an intended CV value in average monofilament diameter include the use of an orifice for sea-island type composite structure formation as described in, for instance, Japanese Examined patent Publication (Kokoku) No. SHO 44-18369 to spin a yarn containing two mutually arrayed components, sea and island, or a mutually arrayed polymer structure. To apply this technique, a commonly-used method is to perform multi-component fiber spinning by using a sea-island type pipe orifice in which dispersion plates are adjusted to achieve uniform dispersion of a molten polymer and the orifice size is adjusted to achieve an appropriate orifice back pressure that allow the ultrafine fibers in composite monofilaments to have uniform fiber diameters.

In the ultrafine fiber bundles, ultrafine fibers may be slightly isolated from each other, partially bonded, or agglomerated. "Bonding" as referred to herein is achieved by chemical reaction, physical fusion, or the like, and "coagulating" is achieved by intermolecular force such as hydrogen bonding.

The entangled fiber sheet, or nonwoven fabric, used to form the polishing pad according to the present invention may also contain thicker fibers than ultrafine fibers as defined above. There are no specific limitations on the diameter of such thicker fibers as referred to herein, but they preferably have fiber diameters in the range of 10 μm to 40 μm. Addition of thicker fibers serves to increase the strength of the polishing pad base and improve characteristics such as cushioning. The polymer adopted to form such thicker fibers than the ultrafine fibers may be identical to the polymer forming the ultrafine fibers. The content of the thicker fibers than the ultrafine fibers in a nonwoven fabric is preferably 50 mass % or less, more preferably 30 mass % or less, and still more preferably 10 mass % or less, to allow the polishing pad base to maintain a smooth surface. It is preferable that the thicker fibers be not exposed in the surface from the viewpoint of polishing performance.

For the present invention, bundles of fibers containing those with a diameter of more than 8.0 μm are regarded as not falling under the category of ultrafine fibers and excluded from the average fibers diameter measurement as described later in connection to measuring methods used in Examples.

Nonwoven fabrics, or entangled fiber sheets, that can be adopted appropriately for the polishing pad according to the present invention include short fiber based nonwoven fabrics produced by forming a laminated fiber web from short fibers using a carding machine and cross-wrapper and processing it by needle punching or water jet punching, long fiber based nonwoven fabrics produced by spunbonding or meltblowing, and nonwoven fabrics produced by using a paper machine. In particular, short fiber based nonwoven fabrics and spunbonded nonwoven fabrics formed of ultrafine fiber bundles according to an embodiment described later can be produced by needle punching. The thickness of a nonwoven fabric as referred to herein is preferably in the range of 1.0 mm or more and 4.0 mm or less. Their density is preferably in the range of 0.15 g/cm$^3$ or more and 0.60 g/cm$^3$ or less.

It is advantageous for a polishing pad base used in the polishing pad according to embodiments of the present invention to consist mainly of a nonwoven fabric, or entangled fiber sheet, as described above that is impregnated with a polyurethane based elastomer in an amount of 20 mass % or more and 50 mass % or less relative to the mass of the polishing pad base. If a polyurethane based elastomer is contained, its binding effect works to prevent the ultrafine fibers from coming off from the polishing pad and allows uniformly napped fibers to be formed by fiber raising. The polyurethane based elastomer contained also serves to allow the polishing pad base to have cushioning property and produce a polishing pad with a uniform thickness. Examples of the polyurethane based elastomer include polyurethane and polyurethane-polyurea elastomers.

Usable polyol components of these polyurethane based elastomers include polyester based, polyether based, or polycarbonate based diols, and copolymers thereof. Further, usable diisocyanate components include aromatic diisocyanate, alicyclic isocyanate, and aliphatic isocyanate.

These polyurethane based elastomers preferably have a weight average molecular weight of 50,000 to 300,000. A weight average molecular weight of 50,000 or more, more preferably 100,000 or more, and still more preferably 150,000 or more, serves to maintain the strength of the polishing pad base and prevent ultrafine fibers from coming off. Further, if the weight average molecular weight is 300,000 or less, more preferably 250,000 or less, an increase in the viscosity of the polyurethane solution can be suppressed, and the ultrafine fiber layer can be more easily impregnated therewith.

The content of a polyurethane based elastomer in the polishing pad base is 20 mass % or more and 50 mass % or less. A content of less than 20 mass % will lead to a decrease in the number of wafers that can be treated appropriately. If the content is more than 50 mass %, on the other hand, there will be an increased number of defects such as scratches and particles. The content of the polyurethane based elastomer is preferably in the range of 20 mass % or more and 40 mass % or less, more preferably 20 mass % or more and 30 mass % or less, and still more preferably 21 mass % or more and 28 mass % or less.

Preferable solvents that can be used when adding the aforementioned polyurethane based elastomer to a nonwoven fabric, i.e., an entangled fiber sheet, include N,N'-dimethyl formamide and dimethyl sulfoxide. Usable polyurethane based elastomers also include an aqueous polyurethane emulsion produced by dispersing it in water.

For instance, an entangled fiber sheet (nonwoven fabric) is immersed in a polyurethane based elastomer solution prepared by dissolving a polyurethane based elastomer in a solvent to add the polyurethane based elastomer to the entangled fiber sheet, followed by drying to substantially coagulate and solidify the polyurethane based elastomer. Drying may be carried out by heating at an appropriate temperature where performance of the entangled fiber sheet and polyurethane based elastomer will not be impaired.

Napping the polishing pad base thus obtained can be carried out by using sand paper or coated abrasive roll. In particular, if sand paper is used, uniform and dense nap can be formed on the surface of the nonwoven fabric.

The polyurethane based elastomer may contain additives such as coloring agent, antioxidant, antistatic agent, dispersing agent, softening agent, solidification adjustor, flame retardant, antibacterial agent, and deodorant as required.

For the polishing pad base to be used for the present invention, the aforementioned addition of a polyurethane based elastomer to a nonwoven fabric may be followed by attaching another elastomer as resin to serve for preventing falling-out of fluff. Preferable elastomers to be attached include the aforementioned polyurethane, polyurea, polyurethane-polyurea elastomer, polyacrylic acid, acrylonitrile-butadiene elastomer, and styrene-butadiene elastomer, of which nitrile butadiene rubber (NBR) is particularly preferable.

The amount of such other elastomers to be attached is preferably 0.5 mass % or more and 6.0 mass % or less relative to the mass of the nonwoven fabric formed of ultrafine fiber bundles and the polishing pad base formed of a polyurethane based elastomer so that adequate capability for preventing falling-out of fluff will be developed. If the amount of such other elastomers to be attached is 6.0 mass % or less, the polishing pad base can maintain good compression characteristics. The amount of such other elastomers to be attached is more preferably in the range of 1.0 mass % or more and 5.0 mass % or less.

The polishing pad base used in the polishing pad according to the present invention, excluding the reinforcement layer described later, preferably has a basis weight of 100 $g/m^2$ or more and 600 $g/m^2$ or less. If the basis weight is 100 $g/m^2$ or more, more preferably 150 $g/m^2$ or more, the polishing pad base will have high morphological stability and dimensional stability, serving to suppress scratch defects and ununiform processing due to stretching of the polishing pad base during polishing operation. If the basis weight is 600 $g/m^2$ or less, more preferably 300 $g/m^2$ or less, on the other hand, the polishing pad will have a high handleability while the cushioning of the polishing pad will be suppressed moderately, serving to suppress the pressing force during polished operation.

The polishing pad base used in the polishing pad according to the present invention, excluding the reinforcement layer described later, preferably has a thickness of 0.1 mm or more and 10 mm or less. If the thickness is 0.1 mm or more, more preferably 0.3 mm or more, the polishing pad base will have high morphological stability and dimensional stability, serving to suppress scratch defects and ununiform processing due to changes in thickness of the polishing pad base during polishing operation. If the thickness of the polishing pad base is 10 mm or less, more preferably 5 mm or less, the pressing force applied during processing operation will spread sufficiently.

In another preferred embodiment, the polishing pad base to be used in the polishing pad according to the present invention may have a reinforcement layer on the surface opposite to the one provided with a porous polyurethane layer composed mainly of wet-solidified polyurethane. The existence of a reinforcement layer allows the polishing pad to have a high morphological stability and dimensional stability and serves to suppress ununiform processing and formation of scratch defects. There are no specific limitations on the method to be used for its formation, and preferred methods include thermocompression bonding and flame lamination. Any appropriate method may be adopted for providing an adhesion layer between the reinforcement layer and the sheet-like material, and the adhesion layer may be of a material with rubber elasticity such as polyurethane, styrene butadiene rubber (SBR), nitrile butadiene rubber (NBR), polyamino acid, and acrylic adhesive. In view of the required cost and practicalities, adhesives such as NBR and SBR are used favorably. A favorable method for applying an adhesive is to spread an emulsion or latex of the adhesive over the sheet-like material.

Adoptable materials for the reinforcement layer include woven fabric, knitted fabric, nonwoven fabric (including paper), and film-like materials (including plastic film and thin metal sheet).

In the polishing pad base in the polishing pad, the surface to be provided with a porous polyurethane layer composed mainly of wet-solidified polyurethane may have nap produced by gigging.

Described next is a method for producing a polishing pad base to be used in the polishing pad according to the present invention.

An entangled fiber sheet such as a nonwoven fabric formed by entangling ultrafine fiber bundles is produced preferably by using ultrafine fiber-generating fibers. It is difficult to produce an entangled fiber sheet directly from ultrafine fibers, but an entangled fiber sheet (nonwoven fabric) formed of entangled ultrafine fiber bundles can be obtained by first producing an entangled fiber sheet from island-in-sea type ultrafine fiber-generating fibers containing sea and island components and then removing the island component from the ultrafine fiber-generating fibers in the entangled fiber sheet to convert them into ultrafine fibers containing only the sea component.

Adoptable ultrafine fiber-generating fibers include: island-in-sea type ones produced by using two thermoplastic resins different in solubility in a solvent as sea component and island component and dissolving and removing the sea component by using a solvent or the like to allow the island component to be left to form ultrafine fibers; and splittable type composite ones produced by alternately disposing two thermoplastic resins, radially or in layers, in the cross section thereof and splitting and separating the two components to form ultrafine fibers.

Island-in-sea type fibers include island-in-sea type composite fibers produced by using an orifice designed for island-in-sea type composite fibers to spin fibers in which two components, sea and island, are mutually arrayed, and blend-spin fibers produced by spinning a mixture of the two components for sea and island, of which island-in-sea type composite fibers have been used favorably because they can serve to produce ultrafine fibers with uniform fineness and also produce ultrafine fibers with an adequate length, thus ensuring sheet-like materials with increased strength.

Usable materials for the sea component of island-in-sea type composite fibers include polyethylene, polypropylene, polystyrene, polyester copolymers of sodiumsulfoisophthalic acid, polyethylene glycol, or the like, and polylactic acid.

The dissolution and removal of the sea component can be performed at any appropriate timing such as before adding a polyurethane based elastomer, i.e., an elastic polymer, after adding a polyurethane based elastomer, or after raising fibers.

As described above, adoptable methods for obtaining a nonwoven fabric to be used for the present invention include entangling a fiber web by needle punching or water jet punching, as well as spunbonding, meltblowing, and the use of papermaking technique, of which needle punching or water jet punching have been used favorably to produce ultrafine fiber bundles as described above.

The needles used for the needle punching operation preferably have 1 to 9 needle barbs (notches). The use of one or more needle barbs allows fibers to be entangled efficiently. The use of 9 or less needle barbs, on the other hand, prevents fibers from being damaged significantly.

The total depth of the needle barbs is preferably 0.04 to 0.09 mm. A total depth of 0.04 mm or more permits efficient entangling of fibers because fiber bundles are pulled adequately. A total depth of 0.09 mm or less serves to prevent fibers from being damaged significantly.

For the needle punching, the number of punches is preferably 1,000 punches/$cm^2$ or more and 4,000 punches/$cm^2$ or less. If the number of punches is 1,000 punches/$cm^2$ or more, high denseness and highly precise finishing can be achieved. Further, if the number of punches is 4,000 punches/$cm^2$ or less, deterioration in processability, damage to fibers, and decrease in strength will be prevented. The number of punches is more preferably 1,500 punches/$cm^2$ or more and 3,500 punches/$cm^2$ or less.

When performing water jet punching, it is preferable to use water in a columnar form. Preferably, water may be squirted through a nozzle with a diameter of 0.05 to 1.0 mm under a pressure of 1 to 60 MPa.

The nonwoven fabric formed of ultrafine fiber-generating fibers having undergone needle punching or water jet punching preferably has an apparent density of 0.15 g/$cm^3$ or more and 0.35 g/$cm^3$ or less. An apparent density of 0.15 g/$cm^3$ or more allows the polishing pad to have a high morphological stability and dimensional stability and serves to suppress ununiform processing and formation of scratch defects during polishing operation. An apparent density of 0.35 g/$cm^3$ or less, on the other hand, serves to maintain adequate spaces to accommodate a polyurethane based elastomer.

It is preferable from the viewpoint of producing denser surface fibers that the nonwoven fabric formed of ultrafine fiber-generating fibers obtained as described above be shrunken by dry heat and/or wet heat to have a higher fiber density. Furthermore, the nonwoven fabric formed of ultrafine fiber-generating fibers may be pressed in the thickness direction by, for instance, calendering.

To dissolve out the high-solubility polymer (sea component) from the ultrafine fiber-generating fibers, an organic solvent such as toluene and trichloroethylene is used when the sea component is a polyolefin as polyethylene and polystyrene. An aqueous alkali solution of sodium hydroxide or the like can be used when the sea component is, for instance, polylactic acid or copolymerized polyester. Ultrafine fiber generation treatment (removal of sea treatment) can be carried out by immersing the nonwoven fabric formed of ultrafine fiber-generating fibers in a solvent and then squeezing out the liquid.

To generate ultrafine fibers from the ultrafine fiber-generating fibers, generally known instruments such as continuous dyeing machine, vibro-washer type sea component removing machine, jet dyeing machine, wince dyeing machine, and jigger dyeing machine can be used. The ultrafine fibers generation treatment described above may be carried out before napping treatment.

For the polishing pad base used for the present invention, the aforementioned addition of a polyurethane based elastomer may be followed by attaching another elastomer as a means of preventing falling-out of fluff during polishing pad formation. The aforementioned polyurethane, polyurea, polyurethane-polyurea elastomer, polyacrylic acid, and acrylonitrile-butadiene elastomer.

The thickness of a polishing pad base is preferably 0.6 mm or more and 1.3 mm or less. A thickness of 0.6 mm or more ensures uniform polishing of a substrate undergoing polishing treatment. A thickness of 1.3 mm or less serves to suppress particle defects.

For the present invention, it is preferable to form a polyurethane based elastomer layer only on the surface of the polishing pad base in order to allow a small amount of an elastomer to work effectively for preventing falling-out of fluff and allow the polishing pad base to maintain good compression characteristics. A preferable method for forming a polyurethane based elastomer only on the surface of the polishing pad base is to prepare an aqueous emulsion of one of various polyurethane based elastomers and apply the polyurethane based elastomer on the napped polishing pad base by a common technique such as coating. This is because a larger amount of the polyurethane based elastomer can be attached to the surface of the polishing pad base as the aqueous polyurethane emulsion spread over the polishing pad base is caused by drying to migrate actively in the thickness direction.

For embodiments of the present invention, the porous polyurethane layer formed mainly of wet-solidified polyurethane has a surface layer (skin layer) with a thickness of several micrometers in which pores are densely formed during the re-solidification of the polyurethane resin, and it contains (on the inner side of the surface layer) an internal layer that includes many larger pores having an average pore size larger than that of the fine pores in the skin layer, preferably about 50 μm to 400 μm. Because the fine pores formed in the skin layer have very small diameters, preferably 10 μm or more and 90 μm or less, the skin layer has a highly flat surface with a surface roughness (Ra) of several micrometers.

This micrometer-level flatness of the skin layer surface serves for finish-polishing of silicon bare wafer, glass, compound semiconductor substrate, hard disk substrate, and other objects under polishing treatment. It should be noted that the grain surface proposed in patent document 2 does not have pores such as those in the skin layer and therefore cannot be used for finish-polishing as in the case of the polishing pad according to the present invention.

The polyurethane based elastomer to be used for the present invention is preferably a polymer having a urethane bond or urea bond that is produced by polymerization of a prepolymer having a plurality of active hydrogen atoms at molecular ends and a compound having an isocyanate group. The prepolymers having a plurality of active hydrogen atoms at molecular ends are divided by the type of backbone chain skeleton into the following groups: polyether based, polycarbonate based, and polycaprolactam based prepolymers.

Organic solvents used for the aforementioned wet solidification include N,N-dimethyl formamide, N,N-dimethyl acetamide, dimethyl sulfoxide, tetrahydrofuran, dioxane, N-methyl pyrolidone, and other polar solvents. To dissolve the polyurethane based elastomer, dimethyl formamide (DMF) is used particularly favorably as solvent.

The polyurethane based elastomer solution may contain other resins including, for instance, polyvinyl chloride, polyester resin, polyethersulfone, and polysulfone, as appropriate. The polyurethane based elastomer solution may also contain other substances including organic pigments such as carbon, surface active agents for decreasing surface tension, and water repellent agents for improving water repellency, as required.

Tools useful for coating the polishing pad base with the polyurethane based elastomer solution include roll coater, knife coater, knife-over-roll coater, and die coater. The solidification bath used to form a porous polyurethane layer after application of the polyurethane based elastomer solution contains a solvent that has affinity with DMF but does not dissolve in polyurethane. In general, water or a mixed solution water of DMF is used favorably.

The porous polyurethane layer used for the present invention preferably has a thickness of 300 μm or more and 1200 μm or less, more preferably 350 μm or more and 700 μm or less. A thickness of 300 μm or more ensures uniform polishing of a substrate undergoing polishing treatment. A thickness of 1,200 μm or less serves to suppress particle defects.

The compression elastic modulus of the polishing pad according to the present invention is calculated from the strain rate at 16 gf/cm$^2$ and 40 gf/cm$^2$ (quantity of compressive strain relative to initial thickness) measured as an increasing pressure from 0 gf/cm$^2$ to 50 gf/cm$^2$ is applied using an indenter with a cross section of 1 cm$^2$. It is advantageous for the polishing pad according to embodiments of the present invention to have a compression elastic modulus of 0.17 MPa or more and 0.32 MPa or less.

This compression elastic modulus value can be achieved by selecting an appropriate combination of a porous polyurethane layer with a material elastic modulus and a polishing pad base. If a porous polyurethane with a high material elastic modulus is selected, the resulting polishing cloth will have a high compression elastic modulus, whereas if one with a low material elastic modulus is selected, the resulting polishing cloth will have a low compression elastic modulus. If a porous polyurethane with a high material elastic modulus is selected, the resulting polishing cloth tends to have a high compression modulus, whereas if one with a low material elastic modulus is selected, the resulting polishing cloth tends to have a low compression elastic modulus. Accordingly, it is preferable that these points be taken into consideration to select an appropriate combination of a porous polyurethane layer and a polishing pad base.

If the compression modulus is less than 0.17 MPa, the wafer being polished will suffer from a larger number of defects caused by scratches and particles. If the compression elastic modulus is more than 0.32 MPa, on the other hand, the number of appropriately processed wafer will increase. It is inferred that the compression elastic modulus of a polishing pad have influence on whether the substrate being polished and the polishing pad surface can come in uniform contact with each other.

For the polishing pad according to the present invention, the micropore-containing surface of the porous polyurethane layer is preferably ground by a grinding tool so as to expose openings in the surface of the porous polyurethane layer and adjust the diameter of the openings. The average surface opening diameter is 10 μm or more and 90 μm or less. The number of particle defects will increase when the average surface opening diameter is less than 10 μm. The number of particle defects will also increase when the average surface opening diameter is more than 90 μm It is more preferably in the range of 20 μm or more and 75 μm or less.

FIG. 1 is a photograph that substitutes for a drawing to show openings in the surface of the porous polyurethane layer of the polishing pad according to an embodiment of the present invention obtained in Example 8. In the surface of the porous polyurethane layer, a large number of independent, irregular, nonuniform openings are exposed to make the surface porous as shown in FIG. 1 The proportion of the open area to the total surface, i.e., opening space ratio, is about 30 to 60%.

For the present invention, it is preferable to perform buffing with sandpaper of #80 to #400, more preferably #100 to #180, as a means of grinding the micropore-forming surface of the porous polyurethane layer and adjusting the diameter of the openings. The use of sandpaper of #80 to #400 serves to suppress the formation of particle defects. In addition, buffing with diamond dresser roll consisting mainly of diamond abrasive grains fixed on the surface of a metal roll can also work as a preferable means of adjusting the diameters of the openings.

To determine the average surface opening diameter, observations of the polishing pad surface were made at a magnification of 50 by scanning electron microscopy (SEM), image-processed with an image processing program called WinROOF, and binarized by coloring the openings black, and the diameters of openings were determined assuming that their shape was a perfect circle area, followed by calculating their average.

For the polishing pad according to the present invention, the surface the porous polyurethane layer, i.e., the top layer, preferably has grid-like grooves or concentric grooves formed therein to ensure stable polishing characteristics.

The polishing pad according to the present invention is used favorably for forming excellent mirror-finished surfaces in articles such as silicon bare wafer, glass, compound semiconductor substrate, and hard disk substrate.

EXAMPLES

The present invention will now be illustrated in detail below with reference to Examples It should be understood, however, that the invention is not construed as being limited to these Examples. Polishing evaluations and measurements were made as described below.

[Polishing Evaluation]

A polishing pad is attached to a polishing machine (model SPP600, supplied by Okamoto Machine Tool Works, Ltd.) using a double-faced adhesive tape and the diameter was adjusted to 610 mm. A 6-inch silicon bare wafer having undergone secondary polishing (using SUBA400 pad) was subjected to polishing test, and polishing evaluation were made under the following conditions.

Platen rotation speed: 46 rpm

Wafer head rotation speed: 49 rpm

Head weight: 100 g/cm$^2$

Quantity of slurry: 700 ml/min (slurry: colloidal silica slurry abrasive grain concentration 1%)

Polishing time: 15 min

[Estimation of the Number of Mirror Finished Surfaces Polished by Polishing Pad]

The following procedure was carried out repeatedly until a significant number of defects were formed: set up a polishing pad, evaluate the number of initial defects under the aforementioned conditions for polishing evaluation, polish a 6-inch silicon wafer with a 1-μm-thick oxide film formed thereon for 6 hours under the polishing conditions given below (corresponding to 15-min polishing for 24 wafers), and polish under the aforementioned polishing evaluation conditions, a 6-inch silicon bare wafer having undergone secondary polishing (using SUBA400 pad) to evaluate the number of defects.

Platen rotation speed: 46 rpm

Wafer head rotation speed: 49 rpm

Head weight: 100 g/cm$^2$

Quantity of slurry: 700 ml/min (slurry: colloidal silica slurry abrasive grain concentration 1%)

[Number of Defects Including Scratches and Particles]

The number of defects of 0.5 μm or more (two wafers, average of two (n=2) measurements) was measured using a dust test apparatus (trade name WM-3, supplied by Topcon Corporation).

[Melting Point]

The peak top temperature showing the melting of the polymer specimen in the 2nd run was measured by DSC-7 supplied by Perkin Elmaer, and used as the melting point of the polymer. The heating rate in this test was 16° C./min, and the sample quantity was 10 mg.

[Melt Flow Rate (MFR)]

Four to five grams of sample pellets were placed in the cylinder of an electric furnace of an MFR meter, and the amount (g/10 min) of the resin extruded in 10 min under a load of 2,160 gf at a temperature of 285° C. was measured using a melt indexer (S101, supplied by Toyo Seiki Co., Ltd. This measuring procedure was carried out 3 times repeatedly, and the average of the measurements was used as the MFR.

[Average Monofilament Diameter of Ultrafine Fibers and CV Value in Average Monofilament Diameter]

An ultrafine-fiber-containing cross section perpendicular to the thickness direction of a polishing pad was observed at a magnification of 3,000 by a scanning electron microscope (SEM) (VE-7800, supplied by Keyence Corporation), and 50 monofilaments were randomly selected from a field of view of 30 μm×30 μm and subjected to diameter determination in μm to three significant figures. This was carried out for three portions to provide diameter measurements from a total of 150 monofilaments, and the third of the significant figures was rounded off to calculate the average to two significant figures. If fibers with fiber diameter of 10 μm coexisted, those fibers were regarded as non-ultrafine fibers and excluded from the determination of the average fiber diameter. When the ultrafine fibers had deformed cross-sectional shapes, the cross sections of monofilaments were measured first and the diameters of the monofilaments were calculated assuming that their cross sections were circular. The standard deviation and average were calculated from these values used as parent population. The standard deviation was divided by the average and represented in percentage (%) to provide the CV in average monofilament diameter.

[Measurement of Compression Elastic Modulus]

Measurements were made by an automated compression testing machine (KESFB3-AUTO-A, supplied by Kato Tech Co., Ltd.) under the following conditions. Using this machine, the pressure was increased from 0 gf/cm$^2$ to 50 gf/cm$^2$ ($\epsilon_{16}$) at 16 gf/cm$^2$ (0.00157 MPa) and the strain rate ($\epsilon_{40}$) at 40 gf/cm$^2$ (0.00392 MPa) were determined and used for calculation (average of five measurements).

Strain rate: (initial thickness−thickness under predetermined pressure)/initial thickness Compression modulus (MPa): $(0.00392-0.00157)/(\epsilon_{40}-\epsilon_{16})$ Indenter size: 1.0 cm$^2$ Indenter speed: 0.02 mm/sec Upper limit load: 50 gf/cm

[Measurement of Average Opening Diameter]

To determine the average surface opening diameter, observations of the polishing pad surface were made at a magnification of 50 by SEM, image-processed with an image processing program called WinROOF, and binarized by coloring the openings black, and the diameters of openings were determined assuming that their shape was a perfect circle area, followed by calculating their average to represent the average opening diameter.

Example 1

[Polishing Pad Base]

(Sea Component and Island Component)

Polyethylene terephthalate (PET) with a MFR 46.5 at its melting point 260° C. was used as island component while polystyrene with a MFR 117 at its melting point of 85° C. was used as sea component.

(Spinning/Stretching)

The abovementioned island component and sea component were melt-spun using an island-in-sea type composite orifice of 16 islands/hole at a spinning temperature of 285° C., an islands/sea mass ratio of 80/20, a discharge rate of 0.9 g/min·hole, and a spinning rate of 1,200 m/min, to obtain a composite fiber. Subsequently, the composite fiber was stretched to 2.8 times by steam stretching, and the fiber was crimped using a force crimper and cut to obtain island-in-sea type composite fibers with a fineness of 4.2 dtex and a fiber length of 51 mm as raw fibers.

(Nonwoven Fabric of Ultrafine Fiber-Generating Fibers)

The abovementioned island-in-sea type composite fibers were used as raw fibers to form a laminated fiber web via carding and crosslapper steps. Subsequently, the resulting laminated fiber web was needle-punched using a needle punching machine containing one needle with a total barb depth 0.08 mm under the conditions of a needle depth of 6 mm and 3,000 punches/cm$^2$, thereby producing a nonwoven fabric formed of ultrafine fiber-generating fibers with a basis weight of 815 g/m$^2$ and an apparent density of 0.225 g/cm$^3$.

(Impregnation with Polyurethane)

The aforementioned nonwoven fabric formed of ultrafine fiber-generating fibers was subjected to hot water shrinkage treatment at a temperature of 95° C., provided with polyvinyl alcohol in an amount of 26 mass % relative to the mass of the fibers, dried, deprived of the sea component, i.e., polystyrene, by dissolving it with trichloroethylene, and dried to provide a nonwoven fabric formed of ultrafine fiber bundles. To the nonwoven fabric formed of ultrafine fiber bundles thus obtained, a polyurethane composed of 75 mass % of polyether based polymer diols and 25 mass % polyester based ones was added so that the mass percentage of the solid polyurethane content in the ultrafine fibers would be 22 mass %, and the polyurethane was solidified with a 30% aqueous DMF solution at a liquid temperature of 35° C., followed by hot water treatment at a temperature of about 85° C. to remove DMF and polyvinyl alcohol. Subsequently, the resulting material was divided in the thickness direction by a halving cutter equipped with endless knives to provide sheet bases. The cut surface of the resulting sheet base was buffed to form nap on the cut surface.

(Addition of Nap Falling-Out Preventing Agent)

The sheet base material was given a 8.5% solution of nitrile butadiene rubber (NBR) (Nipol LX511A, supplied by Zeon Corporation) resin so that the mass percentage of the solid NBR component in the sheet base would be 3.1 mass %, and dried at a temperature of 170° C. to provide a polishing pad base. The resulting polishing pad base had an ultrafine fiber's average monofilament diameter of 4.4 μm, CV value in average monofilament diameter of 6.2%, thickness of 1.08 mm, basis weight of 370 g/m$^2$, and apparent density of 0.343 g/cm$^3$.

(Formation of Porous Polyurethane Layer)

First, 25 parts by mass of polyester MDI (diphenyl methane diisocyanate) polyurethane resin was dissolved in 100 parts by mass of N,N-dimethyl formamide (DMF). Then, 2 parts by mass of carbon black and 2 parts by mass of a hydrophobic active agent were added to prepare a polyurethane solution.

Subsequently, the polyurethane solution was applied to the polishing pad base obtained above with a knife coater, and it was immersed in a water bath to re-solidify the polyurethane and washed in water to remove DMF from the polyurethane, followed by removing moisture by drying to provide a sheet consisting of a polishing pad base and a porous polyurethane layer formed thereon.

(Buffing)

The surface of the porous polyurethane layer of the sheet was buffed with #200 sandpaper while adjusting the grinding degree to an average surface opening diameter of 21 μm to provide a polishing pad having a polyurethane layer with a thickness of 400 μm, apparent density of 0.25 g/cm$^3$, and compression elastic modulus of 0.23 MPa.

As seen in Table 1, the resulting polishing pad showed good evaluation results including a smaller number of defects formed by initial 42-hour polishing and a larger number of wafers that could be processed.

Example 2

[Polishing Pad Base]

Except for adding polyurethane so as to adjust the mass percentage of the solid polyurethane content in the polishing pad base to 25 mass %, the same procedure as in Example 1 was carried out to provide a polishing pad base having an ultrafine fiber's average monofilament diameter of 4.4 μm, CV value in average monofilament diameter of 6.2%, thickness of 1.08 mm, basis weight of 375 g/m$^2$, and apparent density of 0.347 g/cm$^3$.

(Formation of Porous Polyurethane Layer)

First, 30 parts by mass of polyester MDI (diphenyl methane diisocyanate) polyurethane resin was dissolved in 100 parts by mass of N,N-dimethyl formamide (DMF). Then, 2.5 parts by mass of carbon black and 3 parts by mass of a hydrophobic active agent were added to prepare a polyurethane solution.

Subsequently, the polyurethane solution was applied to the aforementioned polishing pad base with a knife coater, and it was immersed in a water bath to re-solidify the polyurethane and washed in water to remove DMF from the polyurethane, followed by removing moisture by drying to provide a sheet consisting of a polishing pad base and a porous polyurethane layer formed thereon.

(Buffing)

The surface of the porous polyurethane layer of the sheet was buffed with #100 sandpaper while adjusting the grinding degree to an average surface opening diameter of 11 μm to provide a polishing pad having a polyurethane layer with a thickness of 450 μm, apparent density of 0.29 g/cm$^3$, and compression elastic modulus of 0.19 MPa.

As seen in Table 1, the resulting polishing pad showed good evaluation results including a smaller number of defects formed by initial 42-hour polishing and a larger number of wafers that could be processed.

Example 3

[Polishing Pad Base]

Except for adding polyurethane so as to adjust the mass percentage of the solid polyurethane content in the polishing pad base to 29 mass %, the same procedure as in Example 1 was carried out to provide a polishing pad base having an ultrafine fiber's average monofilament diameter of 4.4 μm, CV value in average monofilament diameter of 6.2%, thickness of 1.08 mm, basis weight of 379 g/m$^2$, and apparent density of 0.351 g/cm$^3$.

(Formation of Porous Polyurethane Layer)

A porous polyurethane layer was formed on the polishing pad base as in Example 2 to provide a sheet.

(Buffing)

The surface of the porous polyurethane layer of the sheet was buffed while adjusting the grinding degree to an average surface opening diameter of 30 μm to provide a polishing pad with a compression elastic modulus of 0.17 MPa.

As seen in Table 1, the resulting polishing pad showed good evaluation results including a smaller number of defects formed by initial 42-hour polishing and a larger number of wafers that could be processed.

Example 4

(Polishing Pad Base)

Except for using an island-in-sea type composite orifice with 36 islands/hole in the spinning step and adjusting the ultrafine fiber's average monofilament diameter to 3.1 μm, the same procedure as in Example 2 was carried out to provide a polishing pad base having a fiber diameter CV value of 5.2%, thickness of 1.08 mm, basis weight of 370 g/m$^2$, and apparent density of 0.343 g/cm$^3$.

(Formation of Porous Polyurethane Layer)

A porous polyurethane layer was formed on the polishing pad base as in Example 1 to provide a sheet.

(Buffing)

The surface of the porous polyurethane layer of the sheet was buffed while adjusting the grinding degree to an average surface opening diameter of 35 μm to provide a polishing pad with a compression elastic modulus of 0.19 MPa.

As seen in Table 1, the resulting polishing pad showed good evaluation results including a smaller number of defects formed by initial 42-hour polishing and a larger number of wafers that could be processed.

Example 5

(Polishing Pad Base)

Except for using an island-in-sea type composite orifice with 36 islands/hole in the spinning step, adjusting the ultrafine fiber's average monofilament diameter to 3.6 μm, and adding polyurethane so as to adjust the mass percentage of its solid content in the polishing pad base to 26 mass %, the same procedure as in Example 1 was carried out to provide a polishing pad base having a fiber diameter CV value of 5.4%, thickness of 1.08 mm, basis weight of 368 g/m$^2$, and apparent density of 0.341 g/cm$^3$.

(Formation of Porous Polyurethane Layer)

A porous polyurethane layer was formed on the polishing pad base as in Example 1 to provide a sheet.

(Buffing)

The surface of the porous polyurethane layer of the sheet was buffed while adjusting the grinding degree to an average surface opening diameter of 67 μm to provide a polishing pad with a compression elastic modulus of 0.19 MPa.

As seen in Table 1, the resulting polishing pad showed good evaluation results including a smaller number of defects formed by initial 42-hour polishing and a larger number of wafers that could be processed.

Example 6

(Polishing Pad Base)

Except for adjusting the ultrafine fiber's average monofilament diameter to 5.3 μm, the same procedure as in Example 2 was carried out to provide a polishing pad base having an average monofilament diameter CV value of 5.5%, thickness of 1.08 mm, basis weight of 373 g/m$^2$, apparent density of 0.345 g/cm$^3$.

(Formation of Porous Polyurethane Layer)

A porous polyurethane layer was formed on the polishing pad base as in Example 1 to provide a sheet.

(Buffing)

The surface of the porous polyurethane layer of the sheet was buffed while adjusting the grinding degree to an average surface opening diameter of 72 μm to provide a polishing pad with a compression elastic modulus of 0.25 MPa.

As seen in Table 1, the resulting polishing pad showed good evaluation results including a smaller number of defects formed by initial 42-hour polishing and a larger number of wafers that could be processed.

Example 7

(Polishing Pad Base)

Except for using an island-in-sea type composite orifice with 16 islands/hole in the spinning step, adjusting the ultrafine fiber's average monofilament diameter to 5.9 μm, and adding NBR so as to adjust the mass percentage of its solid content in the sheet base to 3.2 mass %, the same procedure as in Example 5 was carried out to provide a polishing pad base having an average fiber diameter CV value of 5.6%, thickness of 1.08 mm, basis weight of 373 g/m$^2$, and apparent density of 0.345 g/cm$^3$.

(Formation of Porous Polyurethane Layer)

A porous polyurethane layer was formed on the polishing pad base as in Example 1 to provide a sheet.

(Buffing)

The surface of the porous polyurethane layer of the sheet was buffed while adjusting the grinding degree to an average surface opening diameter of 89 μm to provide a polishing pad with a compression elastic modulus of 0.27 MPa.

As seen in Table 1, the resulting polishing pad showed good evaluation results including a smaller number of defects formed by initial 42-hour polishing and a larger number of wafers that could be processed.

Example 8

(Polishing Pad Base)

Except for using an island-in-sea type composite orifice with 16 islands/hole in the spinning step, adjusting the ultrafine fiber's average monofilament diameter to 6.2 μm, and adding NBR so as to adjust the mass percentage of its solid content in the sheet base to 3.3 mass %, the same procedure as in Example 5 was carried out to provide a polishing pad base having an average fiber diameter CV value of 5.8%, thickness of 1.08 mm, basis weight of 372 g/m$^2$, and apparent density of 0.344 g/cm$^3$.

(Formation of Porous Polyurethane Layer)

A porous polyurethane layer was formed on the polishing pad base as in Example 1 to provide a sheet.

(Buffing)

The surface of the porous polyurethane layer of the sheet was buffed while adjusting the grinding degree to an average surface opening diameter of 56 μm to provide a polishing pad with a compression elastic modulus of 0.28 MPa. FIG. 1 shows openings in the surface of the porous polyurethane layer constituting the polishing pad obtained in Example 8.

As seen in Table 1, the resulting polishing pad showed good evaluation results including a smaller number of defects formed by initial 42-hour polishing and a larger number of wafers that could be processed.

Example 9

(Polishing Pad Base)

Except for adjusting the ultrafine fiber's average monofilament diameter to 7.5 μm, adding polyurethane so as to adjust the mass percentage of the solid polyurethane content in the sheet base material to 25 mass %, and adding NBR so as to adjust the mass percentage of the solid NBR content in the sheet base to 1.2 mass %, the same procedure as in Example 1 was carried out to provide a polishing pad base having an average fiber diameter CV value of 6.2% thickness of 1.08 mm, basis weight of 368 g/m$^2$, and apparent density of 0.341 g/cm$^3$.

(Formation of Porous Polyurethane Layer)

A porous polyurethane layer was formed on the polishing pad base as in Example 1 to provide a sheet.

(Buffing)

The surface of the porous polyurethane layer of the sheet was buffed while adjusting the grinding degree to an average surface opening diameter of 36 μm to provide a polishing pad with a compression elastic modulus of 0.31 MPa.

As seen in Table 1, the resulting polishing pad showed good evaluation results including a smaller number of defects formed by initial 42-hour polishing and a larger number of wafers that could be processed.

Example 10

(Polishing Pad Base)

Except for adjusting the ultrafine fiber's average monofilament diameter to 7.9 μm, and adding NBR so as to adjust the mass percentage of the solid NBR content in the sheet base to 4.5 mass %, the same procedure as in Example 9 was carried out to provide a polishing pad base having an average fiber diameter CV value of 6.1%, thickness of 1.08 mm, basis weight of 374 g/m$^2$, and apparent density of 0.346 g/cm$^3$.

(Formation of Porous Polyurethane Layer)

A porous polyurethane layer was formed on the polishing pad base as in Example 1 to provide a sheet.

(Buffing)

The surface of the porous polyurethane layer of the sheet was buffed while adjusting the grinding degree to an average surface opening diameter of 32 μm to provide a polishing pad with a compression elastic modulus of 0.32 MPa.

As seen in Table 1, the resulting polishing pad showed good evaluation results including a smaller number of defects formed by initial 42-hour polishing and a larger number of wafers that could be processed.

Example 11

(Polishing Pad Base)

Except for controlling the discharge rate so as to adjust the spinning rate to 600 m/min during the spinning step, adding polyurethane so as to adjust the mass percentage of the solid polyurethane content in the polishing pad base to 25 mass %, and adding NBR so as to adjust the mass percentage of the solid NBR content in the sheet base to 3.7 mass %, the same procedure as in Example 9 was carried out to provide a polishing pad base that had been prepared to have an average surface opening diameter of 21 μm and had an average fiber diameter CV value of 11.2% thickness of 1.08 mm, basis weight of 374 g/m$^2$, apparent density of 0.346 g/cm$^3$.

(Formation of Porous Polyurethane Layer)

A porous polyurethane layer was formed on the polishing pad base as in Example 1 to provide a sheet.

(Buffing)

The surface of the porous polyurethane layer of the sheet was buffed while adjusting the grinding degree to an average surface opening diameter of 21 μm to provide a polishing pad with a compression elastic modulus of 0.31 MPa.

As seen in Table 1, the resulting polishing pad showed good evaluation results including a smaller number of defects formed by initial 42-hour polishing and a larger number of wafers that could be processed.

Example 12

(Polishing Pad Base)

Except for adding polyurethane so as to adjust the mass percentage of the solid polyurethane content in the polishing pad base to 38 mass %, and adding NBR so as to adjust the mass percentage of the solid NBR content in the sheet base to 3.1 mass %, the same procedure as in Example 1 was carried out to provide a polishing pad base having an average fiber diameter CV value of 6.2% thickness of 1.08 mm, basis weight of 378 g/m$^2$, and apparent density of 0.350 g/cm$^3$.

(Formation of Porous Polyurethane Layer)

A porous polyurethane layer was formed on the polishing pad base as in Example 1 to provide a sheet.

(Buffing)

The surface of the porous polyurethane layer of the sheet was buffed while adjusting the grinding degree to an average surface opening diameter of 70 μm to provide a polishing pad with a compression elastic modulus of 0.31 MPa.

As seen in Table 1, the resulting polishing pad showed good evaluation results including a smaller number of defects formed by initial 42-hour polishing and a larger number of wafers that could be processed.

Example 13

(Polishing Pad Base)

Except for adding polyurethane so as to adjust the mass percentage of the solid polyurethane content in the polishing pad base to 49 mass %, and adding NBR so as to adjust the mass percentage of the solid NBR content in the sheet base to 3.1 mass %, the same procedure as in Example 1 was carried out to provide a polishing pad base having an average fiber diameter CV value of 6.2% thickness of 1.08 mm, basis weight of 381 g/m$^2$, and apparent density of 0.353 g/cm$^3$.

(Formation of Porous Polyurethane Layer)

A porous polyurethane layer was formed on the polishing pad base as in Example 1 to provide a sheet.

(Buffing)

The surface of the porous polyurethane layer of the sheet was buffed while adjusting the grinding degree to an average surface opening diameter of 85 μm to provide a polishing pad with a compression elastic modulus of 0.32 MPa.

As seen in Table 1, the resulting polishing pad showed good evaluation results including a smaller number of defects formed by initial 42-hour polishing and a larger number of wafers that could be processed.

Comparative Example 1

(Polishing Pad Base)

Except for adjusting the ultrafine fiber's average monofilament diameter to 2.8 μm during the spinning step, the same procedure as in Example 4 was carried out to provide a polishing pad base having an average monofilament diameter CV value of 6.3%, thickness of 1.08 mm, basis weight of 371 g/m$^2$, apparent density of 0.344 g/cm$^3$.

(Formation of Porous Polyurethane Layer)

A porous polyurethane layer was formed on the polishing pad base as in Example 1 to provide a sheet.

(Buffing)

The surface of the porous polyurethane layer of the sheet was buffed while adjusting the grinding degree to an average surface opening diameter of 30 μm to provide a polishing pad with a compression elastic modulus of 0.17 MPa.

As seen in Table 1, the resulting polishing pad showed poor evaluation results including an increased number of defects formed following a 30-hour polishing period and a smaller number of wafers that could be processed.

Comparative Example 2

(Polishing Pad Base)

Except for adjusting the ultrafine fiber's average monofilament diameter to 8.5 μm during the spinning step, the same procedure as in Example 7 was carried out to provide a polishing pad base having an average monofilament diameter CV value of 6.5%, thickness of 1.08 mm, basis weight of 365 g/m$^2$, apparent density of 0.338 g/cm$^3$.

(Formation of Porous Polyurethane Layer)

A porous polyurethane layer was formed on the polishing pad base as in Example 1 to provide a sheet.

(Buffing)

The surface of the porous polyurethane layer of the sheet was buffed while adjusting the grinding degree to an average surface opening diameter of 35 μm to provide a polishing pad with a compression elastic modulus of 0.30 MPa.

As seen in Table 1, the resulting polishing pad showed poor evaluation results including a large number of defects formed from the beginning.

Comparative Example 3

(Polishing Pad Base)

Except for adding polyurethane so as to adjust the mass percentage of the solid polyurethane content in the polishing pad base to 18 mass %, and adding NBR so as to adjust the mass percentage of the solid NBR content in the sheet base to 3.2 mass %, the same procedure as in Example 1 was carried out to provide a polishing pad base having an average fiber diameter CV value of 6.2% thickness of 1.08 mm, basis weight of 362 g/m$^2$, and apparent density of 0.335 g/cm$^3$.

(Formation of Porous Polyurethane Layer)

A porous polyurethane layer was formed on the polishing pad base as in Example 1 to provide a sheet.

(Buffing)

The surface of the porous polyurethane layer of the sheet was buffed while adjusting the grinding degree to an average surface opening diameter of 67 μm to provide a polishing pad with a compression elastic modulus of 0.31 MPa.

As seen in Table 1, the resulting polishing pad showed poor evaluation results including an increased number of defects formed following a 24-hour polishing period and a smaller number of wafers that could be processed.

Comparative Example 4

(Polishing Pad Base)

Except for adding polyurethane so as to adjust the mass percentage of the solid polyurethane content in the polishing pad base to 53 mass %, and adding NBR so as to adjust the mass percentage of the solid NBR content in the sheet base to 3.3 mass %, the same procedure as in Example 1 was carried out to provide a polishing pad base having an average fiber diameter CV value of 6.2% thickness of 1.08 mm, basis weight of 379 g/m$^2$, and apparent density of 0.351 g/cm$^3$.

(Formation of Porous Polyurethane Layer)

A porous polyurethane layer was formed on the polishing pad base as in Example 1 to provide a sheet.

(Buffing)

The surface of the porous polyurethane layer of the sheet was buffed while adjusting the grinding degree to an average surface opening diameter of 72 μm to provide a polishing pad with a compression elastic modulus of 0.17 MPa.

As seen in Table 1, the resulting polishing pad showed poor evaluation results including a large number of defects formed from the beginning.

Comparative Example 5

(Polishing Pad Base)

Except for using an island-in-sea type composite orifice with 36 islands/hole in the spinning step, adjusting the ultrafine fiber's fiber diameter to 3.1 μm, and adding polyurethane so as to adjust the mass percentage of the solid polyurethane content relative to the ultrafine fibers to 29 mass %, the same procedure as in Example 2 was carried out to provide a polishing pad base having a fiber diameter CV value of 5.2%, thickness of 1.08 mm, basis weight of 390 g/m$^2$, and apparent density of 0.361 g/cm$^3$.

(Formation of Porous Polyurethane Layer)

First, 25 parts by mass of polyester MDI (diphenyl methane diisocyanate) polyurethane resin was dissolved in 100 parts by mass of DMF. Then, 2 parts by mass of carbon black and 2 parts by mass of a hydrophobic active agent were added to prepare a polyurethane solution.

Subsequently, the polyurethane solution was applied to the aforementioned polishing pad base with a knife coater, and it was immersed in a water bath to re-solidify the polyurethane and washed in water to remove DMF from the polyurethane, followed by removing moisture by drying to provide a re-solidified polyurethane polishing pad having a layer in which micropores had been formed.

(Buffing)

The surface of the porous polyurethane layer of the sheet was buffed while adjusting the grinding degree to an average surface opening diameter of 57 μm to provide a polishing pad having a polyurethane layer with a thickness of 400 μm, apparent density of 0.25 g/cm$^3$, and compression elastic modulus of 0.16 MPa.

As seen in Table 1, the resulting polishing pad showed poor evaluation results including a large number of defects formed from the beginning.

Comparative Example 6

(Polishing Pad Base)

Except for adjusting the ultrafine fiber's average monofilament diameter to 7.9 μm, and adding polyurethane so as to adjust the mass percent of the solid polyurethane content in the polishing pad base to 21 mass %, the same procedure as in Example 9 was carried out to provide a polishing pad base having an average fiber diameter CV value of 6.1%, thickness of 1.08 mm, basis weight of 354 g/m$^2$, and apparent density of 0.328 g/cm$^3$.

(Formation of Porous Polyurethane Layer)

First, 25 parts by mass of polyester MDI (diphenyl methane diisocyanate) polyurethane resin was dissolved in 100 parts by mass of DMF. Then, 2 parts by mass of carbon black and 2 parts by mass of a hydrophobic active agent were added to prepare a polyurethane solution.

Subsequently, the polyurethane solution was applied to the aforementioned polishing pad base with a knife coater, and it was immersed in a water bath to re-solidify the polyurethane and washed in water to remove DMF from the polyurethane, followed by removing moisture by drying to provide a re-solidified polyurethane polishing pad having a layer in which micropores had been formed.

(Buffing)

The surface of the porous polyurethane layer of the sheet was buffed while adjusting the grinding degree to an average surface opening diameter of 36 μm to provide a polishing pad having a polyurethane layer with a thickness of 400 μm, apparent density of 0.25 g/cm$^3$, and compression elastic modulus of 0.33 MPa.

As seen in Table 1, the resulting polishing pad showed poor evaluation results including an increased number of defects formed following a 18-hour polishing period and a smaller number of wafers that could be processed.

Comparative Example 7

A polishing pad was prepared according the procedure described in Example 1 of patent document 2.

(Polishing Pad Base)

(Raw Fiber)

(Sea Component and Island Component)

PET copolymerized with 8 mol % 5-sulfoisophthalic acid sodium was used as sea component while PET was used as island component.

(Spinning/Stretching)

Using an islands-in-sea type orifice with 36 islands/hole, the aforementioned island and sea components were melt-spun at an island/sea ratio by mass of 55/45 to provide a composite fiber. Subsequently, the fiber was stretched to 2.8 times and crimped using a force crimper and cut to provide, as raw fiber, an island-in-sea type composite fiber with a composite fiber fineness of 2.8 dtex and fiber length of 51 mm.

(Nonwoven Fabric of Ultrafine Fiber-Generating Fibers)

The abovementioned island-in-sea type composite fiber was used as raw fiber to form a laminated fiber web via carding and crosslapper steps. Subsequently, the resulting laminated fiber web was needle-punched using a needle punching machine to provide a nonwoven fabric formed of ultrafine fiber-generating fibers.

(Impregnation with Polyurethane)

The aforementioned nonwoven fabric formed of ultrafine fiber-generating fibers was subjected to hot water shrinkage treatment at a temperature of 90° C. for 2 min and dried at 100° C. for 5 min. Then, it was impregnated with a self-emulsifiable, aqueous polyurethane dispersion A with a solid content of 25 mass % and hot-air dried at a drying temperature of 120° C. for 10 min to provide a polyurethane-impregnated sheet in which the weight of polyurethane accounted for 30 mass % relative to the weight of the island component in the nonwoven fabric (the ratio between the island component and polyurethane being 77:23 by mass).

Subsequently, this sheet was immersed in an aqueous sodium hydroxide solution with a concentration of 10 g/L heated at 90° C. and treated for 30 min to remove the sea component from the island-in-sea type fiber, thus providing a sheet free of a sea component. The resulting sheet base was halved and the cut surface was buffed with 180-mesh sandpaper to form nap on the cut surface. The ultrafine fibers had an average monofilament diameter of 2.2 μm, average monofilament diameter CV value of 7.8%.

(Aqueous polyurethane dispersion A: polyurethane containing 0.2 mass % of silicone, prepared by using poly(3-methyl pentane carbonate) as diol, dicyclohexyl methane diisocyanate as isocyanate, hexamethylene diamine as chain elongation agent, and nonionic internal emulsifier.)

(Production of Porous Polyurethane Layer)

A self-emulsifiable, aqueous polyurethane dispersion F (with a solid content of 30 mass %) thickened with an aqueous viscosity improver was applied to a piece of release paper (trade name AR-130SG, supplied by Asahi Roll Co., Ltd.) at an aqueous polyurethane dispersion coating weight of 80 g/m$^2$, which was coated with an adhesion layer after drying. While the adhesion layer was in a semidry state in which some degree of adhesiveness remained, it was joined with the polishing surface of the polishing pad base as they were travelling between metal rollers. The release paper was peeled off after ageing for 2 days in an atmosphere at 40 to 50° C.

(Buffing)

The surface of the polyurethane layer of the sheet was buffed with #200 sandpaper to provide a polishing pad with an apparent density of 0.48 g/cm$^3$ and compression elastic modulus of 0.30 MPa. Few opening were found in the surface of the polishing pad, and the average opening diameter was a small 8 μm.

As seen in Table 1, the resulting polishing pad showed poor evaluation results including a very large number of defects formed from the beginning, and was not able to work appropriately.

Comparative Example 8

(Polishing Pad Base)

Except for dissolving and removing polyvinyl alcohol before addition of polyurethane, then adding polyurethane so as to adjust the mass percentage of the solid polyurethane content in the polishing pad base to 25 mass %, and adding NBR so as to adjust the mass percentage of the solid NBR content in the sheet base to 3.5 mass %, the same procedure as in Example 1 was carried out to provide a polishing pad base having an average fiber diameter CV value of 6.2% thickness of 1.08 mm, basis weight of 382 g/m$^2$, and apparent density of 0.354 g/cm$^3$.

(Formation of Porous Polyurethane Layer)

A porous polyurethane layer was formed on the polishing pad base as in Example 1 to provide a sheet.

(Buffing)

The surface of the porous polyurethane layer of the sheet was buffed while adjusting the grinding degree to an average surface opening diameter of 95 μm to provide a polishing pad with a compression elastic modulus of 0.19 MPa.

As seen in Table 1, the resulting polishing pad showed poor evaluation results including a large number of defects formed from the beginning.

Comparative Example 9

(Polishing Pad Base)

Except for dissolving and removing polyvinyl alcohol before addition of polyurethane, then adding polyurethane so as to adjust the mass percentage of the solid polyurethane content in the polishing pad base to 25 mass %, and adding NBR so as to adjust the mass percentage of the solid NBR content in the sheet base to 3.5 mass %, the same procedure as in Example 1 was carried out to provide a polishing pad base having an average fiber diameter CV value of 6.2% thickness of 1.08 mm, basis weight of 382 g/m$^2$, and apparent density of 0.354 g/cm$^3$.

(Formation of Porous Polyurethane Layer)

A porous polyurethane layer was formed on the polishing pad base as in Example 1 to provide a sheet.

(Buffing)

Without buffing the surface of the porous polyurethane layer of the sheet, a polishing pad with a compression modulus of 0.19 MPa was prepared.

As seen in Table 1, the resulting polishing pad showed poor evaluation results including a large number of defects formed from the beginning.

TABLE 1

| | | polishing pad base | | | | | polishing | mirror finished surface of silicon wafer | | | | | | | |
|---|---|---|---|---|---|---|---|---|---|---|---|---|---|---|---|
| | | ave. fiber diam. (μm) | Poly-urethane content (mass %) | CV in fiber diam. | NBR (mass %) | sur-face opening diam. (μm) | pad's compres-sion modulus (MPa) | Initial defects number | defects after 6-hour polish-ing number | defects after 12-hour polish-ing number | defects after 18-hour polish-ing number | defects after 24-hour polish-ing number | defects after 30-hour polish-ing number | defects after 36-hour polish-ing number | defects after 42-hour polish-ing number |
| Example | 1 | 4.4 | 21 | 6.2 | 3.1 | 21 | 0.23 | 16 | 10 | 21 | 24 | 33 | 25 | 26 | 21 |
| | 2 | 4.4 | 25 | 6.2 | 3.1 | 11 | 0.19 | 54 | 53 | 61 | 52 | 49 | 47 | 62 | 53 |
| | 3 | 4.4 | 29 | 6.2 | 3.1 | 30 | 0.17 | 43 | 47 | 43 | 39 | 44 | 42 | 48 | 46 |
| | 4 | 3.1 | 25 | 5.2 | 3.1 | 35 | 0.19 | 10 | 15 | 24 | 16 | 24 | 23 | 22 | 21 |
| | 5 | 3.6 | 26 | 5.4 | 3.1 | 67 | 0.19 | 19 | 21 | 24 | 20 | 25 | 23 | 22 | 29 |
| | 6 | 5.3 | 25 | 5.5 | 3.1 | 72 | 0.25 | 18 | 14 | 25 | 32 | 24 | 27 | 21 | 25 |
| | 7 | 5.9 | 26 | 5.6 | 3.2 | 89 | 0.27 | 55 | 53 | 56 | 63 | 57 | 61 | 56 | 62 |
| | 8 | 6.2 | 26 | 5.8 | 3.3 | 56 | 0.28 | 18 | 17 | 19 | 20 | 22 | 21 | 23 | 24 |
| | 9 | 7.5 | 25 | 6.2 | 1.2 | 36 | 0.31 | 23 | 22 | 23 | 27 | 32 | 24 | 25 | 25 |
| | 10 | 7.9 | 24 | 6.1 | 4.5 | 32 | 0.32 | 25 | 22 | 27 | 34 | 32 | 25 | 34 | 33 |
| | 11 | 7.5 | 25 | 11.2 | 3.7 | 21 | 0.31 | 35 | 34 | 33 | 32 | 34 | 33 | 23 | 34 |
| | 12 | 4.4 | 38 | 6.2 | 3.1 | 70 | 0.31 | 40 | 39 | 36 | 43 | 30 | 35 | 34 | 37 |
| | 13 | 4.4 | 49 | 6.2 | 3.1 | 85 | 0.32 | 34 | 37 | 40 | 32 | 41 | 42 | 43 | 39 |
| Comparative example | 1 | 2.8 | 25 | 6.3 | 3.1 | 30 | 0.17 | 24 | 33 | 27 | 38 | 45 | 89 | 102 | 150 |
| | 2 | 8.5 | 26 | 6.5 | 3.2 | 35 | 0.30 | 85 | 87 | 93 | 78 | 97 | 89 | 91 | 93 |
| | 3 | 4.4 | 18 | 6.2 | 3.2 | 67 | 0.31 | 24 | 35 | 33 | 53 | 75 | 95 | 130 | 160 |
| | 4 | 4.4 | 53 | 6.2 | 3.3 | 72 | 0.17 | 88 | 92 | 99 | 87 | 89 | 93 | 91 | 89 |
| | 5 | 3.1 | 29 | 5.2 | 3.1 | 57 | 0.16 | 102 | 99 | 120 | 106 | 108 | 101 | 115 | 112 |
| | 6 | 7.9 | 21 | 6.1 | 4.5 | 36 | 0.33 | 21 | 35 | 46 | 75 | 87 | 110 | 115 | 135 |
| | 7 | 2.2 | 23 | 7.8 | — | 8 | 0.30 | 135 | 269 | —* | —* | —* | —* | —* | —* |
| | 8 | 4.4 | 25 | 6.2 | 3.5 | 95 | 0.19 | 98 | 89 | 91 | 104 | 95 | 98 | 93 | 97 |
| | 9 | 4.4 | 25 | 6.2 | 3.5 | 0 | 0.19 | 250 | 350 | —* | —* | —* | —* | —* | —* |

*Test was discontinued due to excessive defects.

The invention claimed is:

1. A polishing pad comprising a laminate including a polishing pad base and a porous polyurethane layer, the polishing pad base comprising a nonwoven fabric impregnated with a polyurethane based elastomer, the nonwoven fabric being formed of bundles of ultrafine fibers with an average monofilament diameter of 3.0 μm or more and 8.0 μm or less and the polyurethane based elastomer being present in an amount of 20 mass % or more and 50 mass % or less relative to the mass of the polishing pad base, and the porous polyurethane layer containing polyurethane as a primary component, wherein the porous polyurethane layer has openings with an average opening diameter of 10 μm or more and 90 μm or less in its surface and the compression elastic modulus is 0.17 MPa or more and 0.32 MPa or less.

2. A polishing pad as described in claim 1 wherein the ultrafine fiber's average monofilament diameter is 3.5 μm or more and 6.0 μm or less.

3. A polishing pad as described in either claim 1 or 2 wherein the polyurethane based elastomer accounts for 20 mass % or more and 30 mass % or less relative to the polishing pad base.

4. A polishing pad as described in claim 1 wherein the nonwoven fabric contains a nitrile butadiene based elastomer.

5. A polishing pad as described in claim 1 wherein the coefficient of variation of the average monofilament diameter of the ultrafine fibers in the nonwoven fabric is 10% or less.

* * * * *